US008465015B2

(12) United States Patent
Fujiwara et al.

(10) Patent No.: US 8,465,015 B2
(45) Date of Patent: Jun. 18, 2013

(54) IMAGE FORMING APPARATUS AND CONTROL METHOD THEREFOR

(75) Inventors: Hiroshi Fujiwara, Osaka (JP); Tomoyoshi Yamazaki, Tokyo (JP); Haruyuki Honda, Osaka (JP); Toshikane Nishii, Osaka (JP); Mizuna Tanaka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/067,307

(22) Filed: May 24, 2011

(65) Prior Publication Data

US 2011/0291353 A1 Dec. 1, 2011

(30) Foreign Application Priority Data

May 28, 2010 (JP) ..... 2010-122482

(51) Int. Cl.
*B65H 5/00* (2006.01)

(52) U.S. Cl.
USPC ..... 271/10.03; 271/242; 271/258.01

(58) Field of Classification Search
USPC ..... 271/4.03, 4.1, 10.03, 10.11, 258.01, 271/265.01, 242, 245, 246
See application file for complete search history.

(56) References Cited

U.S. PATENT DOCUMENTS 5,671,466 A * 9/1997 Hokamura et al. ..... 399/124
5,676,363 A * 10/1997 Kishida et al. ..... 271/10.01
6,733,008 B2 * 5/2004 Waragai et al. ..... 271/242
7,156,388 B2 * 1/2007 Kang et al. ..... 271/110
7,900,917 B2 * 3/2011 Fujiwara et al. ..... 271/265.04
2005/0167904 A1 * 8/2005 Yamazaki ..... 271/10.01
2010/0019440 A1 * 1/2010 Fujiwara et al. ..... 271/10.02

FOREIGN PATENT DOCUMENTS

JP 10194529 A 7/1998
JP 11065370 A 3/1999
JP 2007121885 A 5/2007
JP 2008013338 A 1/2008

* cited by examiner

*Primary Examiner* — Michael McCullough

(74) *Attorney, Agent, or Firm* — Harness, Dickey & Pierce, P.L.C.

(57) ABSTRACT

An image forming apparatus for which a control method is performed includes a recording unit, a conveying device conveying a recording medium to the recording unit, a feeding device supplying the recording medium to the conveying device, a recording medium conveying pathway along which the recording medium travels, and a control device controlling the conveying device and the feeding device. A first partial length of the recording medium conveying pathway extending from the feeding device to the recording unit is shorter than a conveyance direction length of a maximum usable size recording medium. When the leading end of the recording medium is located between the conveying device and the recording unit after the conveying device is driven to convey the recording medium, the control device switches the feeding device from a driven state to a non-driven state to move the feeding device by the recording medium.

13 Claims, 7 Drawing Sheets

IMAGE FORMING APPARATUS AND CONTROL METHOD THEREFOR

CROSS-REFERENCE TO RELATED APPLICATIONS

The present invention claims priority pursuant to 35 U.S.C. §119 from Japanese Patent Application No. 2010-122482, filed on May 28, 2010 in the Japan Patent Office, the contents and disclosures of which are hereby incorporated by reference herein in their entirety.

BACKGROUND OF THE INVENTION

1. Field of the Invention

The present invention relates to an image forming apparatus in which a length of a sheet conveying pathway extending from a feeding device to a recording unit is shorter than a conveyance direction length of a maximum usable size sheet, and a control method therefor.

2. Description of the Related Art

There is known a small-sized image forming apparatus in which a sheet conveyance distance from a sheet feeding unit to an image recording unit is relatively short. When conveying a sheet to the image recording unit in synchronization with image recording timing, therefore, it is necessary to drive the feeding device and assist the sheet conveyance to adjust the image position.

If the sheet size set by a user is different from the size of the sheet actually set in an image forming apparatus, such as a printer, and if the length in the sheet conveyance direction (hereinafter, referred to as the "conveyance direction length") of the actually set sheet is shorter than the conveyance direction length of the user-set sheet size, a second sheet is also fed and conveyed from the sheet feeding unit and is consequently wasted.

Further, in the case of an image forming apparatus that heats and fixes a toner image on a sheet by using a fixing roller or a fixing belt, the image is formed on the leading end of the second sheet, and thus the second sheet winds around the fixing roller or the fixing belt.

Methods addressing the above-described issues have been proposed which include detecting the sheet size in accordance with the set position of a side fence or an end fence that regulates the position of a sheet set in a sheet storage unit of the image forming apparatus, and detecting the length of a sheet fed and conveyed from the sheet feeding unit by providing the sheet storage unit with a device for detecting the trailing end of the sheet.

Further, to prevent the second sheet from winding around the fixing roller when the user-set sheet size is different from the size of the sheet actually set in the sheet feeding unit, a method has been proposed which temporarily stops a sheet feeding roller in a sheet feeding operation immediately after the sheet feeding roller has fed a sheet by a distance corresponding to half the conveyance direction length of the user-set sheet size, rotates the sheet feeding roller again, determines, if a sheet detection sensor detects a sheetless state during the sheet conveying process, that the actually set sheet size is different from the user-set sheet size, and stops the sheet conveyance. According to this method, to prevent the sheet feeding roller from acting as a load during the temporary stoppage thereof when the user-set sheet size matches the size of the sheet actually set in the sheet feeding unit, gate rollers (i.e., a pair of registration rollers) are provided between the sheet feeding roller and a transfer unit to correct oblique conveyance of the sheet by abutting the sheet against the gate rollers and flexing the sheet. The amount of flexure of the sheet is set to be larger than the amount of conveyance of the sheet conveyed by the gate rollers during the stop time in which the sheet feeding roller is temporarily stopped.

Further, according to another method, to detect the length of the fed and conveyed sheet in an early stage a sheet feeding device is provided with a trailing end detection device that detects that the trailing end of the fed sheet has passed a predetermined trailing end detection position in a manual feed tray.

According to the above-described method of detecting the size of the sheet set in the sheet storage unit, however, it is necessary to install a size detection mechanism and a sheet trailing end detection device, which operate in conjunction with the side fence or the end fence. Therefore, the image forming apparatus is increased in size and cost. Further, in manual sheet feeding using a sheet storage unit exposed to the outside of the image forming apparatus, the regulation of the sheet set position is limited to the regulation in the sheet width direction by the side fence. Thus, the detection of the conveyance direction size of the sheet by the use of the end fence is not performed, and there is difficulty in providing the sheet trailing end detection device.

Further, according to the first method described above, if the conveyance direction length of the actually set sheet is equal to or less than half the conveyance direction length of the user-set sheet size, a gap is formed between the first and second sheets and allows the sheet detection sensor to detect the sheetless state. However, if the conveyance direction length of the actually set sheet is more than half the conveyance direction length of the user-set sheet size, e.g., if the user-set sheet size is A4 portrait and the actually set sheet size is A5 portrait, no gap is formed between the first and second sheets. Thus, the sheet detection sensor fails to detect the sheetless state, and the sheet conveyance is not stopped. As a result, the second sheet is wasted.

Further, according to the first method described above, a gap of approximately 15 mm to approximately 20 mm is required for the detection of the sheetless state by the sheet detection sensor using a swing lever (feeler), which is normally used in a small-sized printer. However, the amount of flexure of the sheet for correcting the oblique conveyance of the sheet is normally approximately 2 mm to approximately 4 mm. If the amount of flexure of the sheet is increased, therefore, the sheet interferes with a conveying guide, and results in an increase in conveyance noise and damage to the sheet such as crumpling. Further, in the case of a relatively thick sheet, in which an image failure such as shock jitter tends to occur, the resilience of the sheet is relatively high. Even if the amount of flexure of the sheet is set to a relatively large value, therefore, the sheet skids on the sheet feeding roller, and the actual amount of flexure of the sheet is not increased, resulting in image failure such as shock jitter.

SUMMARY OF THE INVENTION

The present invention describes an image forming apparatus. In one example, an image forming apparatus includes a recording unit to record an image on a recording medium, a conveying device to convey the recording medium to the recording unit, a feeding device to supply the recording medium to the conveying device, a recording medium conveying pathway along which the recording medium travels and having a first partial length thereof extending from the feeding device to the recording unit shorter than a conveyance direction length of a maximum usable size recording medium, and a control device to control the driving of the conveying device and the feeding device. When the leading end of the recording medium is located between the conveying device and the recording unit after the start of driving of the conveying device to convey the recording medium to the recording unit, the control device switches the feeding device from a driven state to a non-driven state to cause the feeding device to be moved by the recording medium conveyed by the conveying device.

The above-described image forming apparatus may include a recording medium storage unit to store a plurality of stacked recording media. The feeding device may separate and feed a single recording medium from the recording medium storage unit.

A second partial length of the recording medium conveying pathway extending between the feeding device and the conveying device may lack a device for conveying the recording medium.

When the feeding device is switched from the driven state to the non-driven state after the start of driving of the conveying device to convey the recording medium supplied by the feeding device to the recording unit, a third partial length of the recording medium conveying pathway extending between the position of the leading end of the recording medium and the feeding device may be shorter than the conveyance direction length of a minimum usable size recording medium.

The above-described image forming apparatus may include a recording medium detection device provided between the conveying device and the recording unit, and detect the recording medium. The control device may switch the feeding device from the driven state to the non-driven state based on recording medium detection information provided by the recording medium detection device.

A fourth partial length of the recording medium conveying pathway extending from the feeding device to the recording medium detection device may be shorter than the conveyance direction length of a minimum usable size recording medium.

The above-described image forming apparatus may include a recording medium detection device provided between the feeding device and the conveying device to detect the recording medium. Based on recording medium detection information provided by the recording medium detection device, the control device may stop the driving of the feeding device to cause the recording medium to stop in front of the conveying device or be abutted against and stopped by the conveying device. The control device may switch the feeding device from the driven state to the non-driven state after the lapse of a predetermined time since the start of driving of one of the feeding device and the conveying device to convey the recording medium to the recording unit.

The control device may detect the conveyance direction length of the recording medium based on the recording medium detection information provided by the recording medium detection device.

The control device may determine whether or not the conveyance direction length of the recording medium detected based on the recording medium detection information provided by the recording medium detection device matches the conveyance direction length of the image to be recorded on the recording medium. If it is determined that the conveyance direction length of the recording medium does not match the conveyance direction length of the image, the control device may perform a process of handling the size mismatch of the recording medium and issues a warning of the size mismatch.

If it is determined that the conveyance direction length of the recording medium detected based on the recording medium detection information provided by the recording medium detection device is longer than the conveyance direction length of the image to be recorded on the recording medium, the control device may perform the process of handling the size mismatch of the recording medium and issues the warning of the size mismatch.

The control device may determine whether or not the conveyance direction length of the recording medium detected based on the recording medium detection information provided by the recording medium detection device matches the conveyance direction length of the image to be recorded on the recording medium. If it is determined that the conveyance direction length of the recording medium does not match the conveyance direction length of the image, the control device may perform the conveyance and discharge of the recording medium by controlling the conveyance of the recording medium in accordance with the conveyance direction length of the recording medium detected based on the recording medium detection information provided by the recording medium detection device.

If the recording medium detection device does not detect the trailing end of the recording medium by a recording medium trailing end detection time of the recording medium detection device calculated from the preset maximum conveyance direction length of the recording medium, the control device may determine a recording medium conveyance failure, and stops the conveyance of the recording medium.

Further, in one example, a control method for an image forming apparatus having a recording medium feeding device and a recording medium conveying device includes the steps of detecting a recording medium with a detection device provided between the feeding device and the conveying device, stopping driving of the feeding device to cause the recording medium to stop in front of the conveying device or be abutted against and stopped by the conveying device using a control device, based on recording medium detection information provided in the detecting step, and switching the feeding device from a driven state to a non-driven state after lapse of a predetermined time since the start of driving of one of the feeding device and the conveying device to convey the recording medium to the recording unit.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
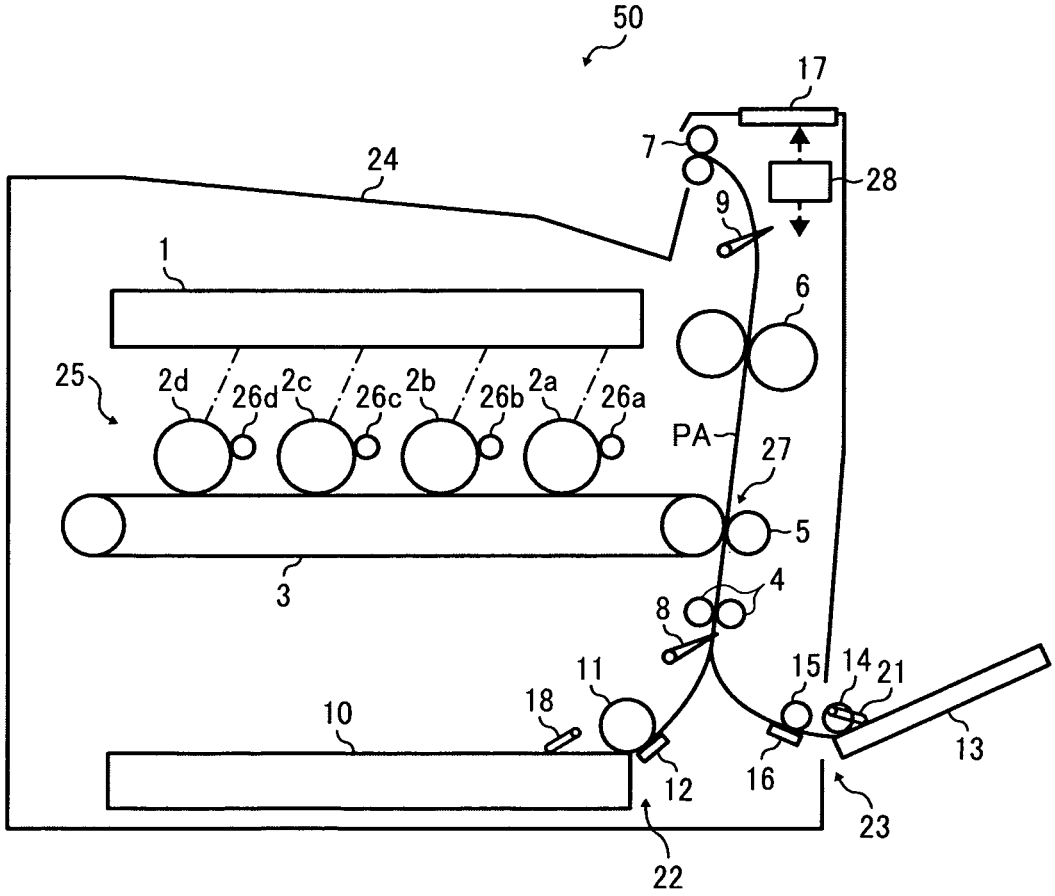
FIG. 1 is a diagram illustrating a schematic configuration of an image forming apparatus according to Embodiment 1 of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Embodiment 1

A configuration of an image forming apparatus according to Embodiment 1 of the present invention will be first described. With reference to FIG. 1, a schematic configuration of the image forming apparatus according to Embodiment 1 will be described. FIG. 1 is a schematic diagram of the image forming apparatus configured as a small-sized full-color printer including a commonly used electrophotographic image forming device.

An image forming apparatus 50 includes an image forming unit 25 including photoconductors 2*a*, 2*b*, 2*c*, and 2*d* (hereinafter, occasionally collectively referred to as the "photoconductors 2"), an exposure device 1, development devices 26*a*, 26*b*, 26*c*, and 26*d* (hereinafter, occasionally collectively referred to as the "development devices 26"), an intermediate transfer belt 3, and so forth. On the photoconductors 2*a*, 2*b*, 2*c*, and 2*d*, respective toner images of black, cyan, magenta, and yellow colors (hereinafter, occasionally referred to as "K", "C", "M", and "Y", respectively) are formed in this order. The exposure device 1 writes latent images on the photoconductors 2 by using laser. The development devices 26 form toner images on the photoconductors 2. On the intermediate transfer belt 3, the toner images of the respective colors are superimposed upon one another. The suffixes a, b, c, and d, as in the photoconductors 2*a*, 2*b*, 2*c*, and 2*d* and the development devices 26*a*, 26*b*, 26*c*, and 26*d*, correspond to the BK, C, M, and Y colors, respectively. In the following description, the photoconductors 2*a*, 2*b*, 2*c*, and 2*d* and the development devices 26*a*, 26*b*, 26*c*, and 26*d* will be simply referred to as the photoconductors 2 and the development devices 26 where distinction among the colors is unnecessary.

The image forming apparatus 50 includes a sheet feeding unit 22 and a manual sheet feeding unit 23. The sheet feeding unit 22 is provided inside the image forming apparatus 50, and includes a sheet feeding tray 10, a sheet feeding roller 11, and a separating device 12. The manual sheet feeding unit 23 includes a manual sheet feeding tray 13, a pickup roller 14, a sheet feeding roller 15, and a separating device 16. The sheet feeding unit 22 and the manual sheet feeding unit 23 respectively include sheet detection devices 18 and 21 that detect a sheet, i.e., a recording medium.

After the leading end of a sheet fed from the sheet feeding unit 22 or the manual sheet feeding unit 23 is detected by a registration sensor 8 provided in front of a pair of registration rollers 4, the leading end of the sheet abuts against the pair of registration rollers 4, and the sheet is flexed with the oblique conveyance thereof corrected. Thereafter, the sheet feeding roller 11 or the combination of the sheet feeding roller 15 and the pickup roller 14 is caused to stop and stand by.

Then, the pair of registration rollers 4 is driven in proper timing to convey the sheet to a secondary transfer roller 5 such that the sheet synchronizes with the image formed by the image forming unit 25.

The image is transferred onto the sheet from the intermediate transfer belt 3 by the secondary transfer roller 5, and is fixed to the sheet by a fixing device 6. Thereafter, the printed sheet is discharged onto a sheet discharging tray 24 from sheet discharging rollers 7.

The sheet travels along a conveying pathway PA that extends from the sheet feeding roller 11 of the sheet feeding tray 10 or the sheet feeding roller 14 of the sheet feeding tray 13, via the pair of registration rollers 4, the secondary transfer roller 5, and the fixing device 6 to the sheet discharging rollers 7.

A fixed and discharged sheet sensor 9 performs monitoring for a conveyance failure by detecting the leading end of the sheet conveyed from the fixing device 6 and the trailing end of the sheet discharged by the sheet discharging rollers 7.

An operation unit 17 includes buttons for instructing an operation and performing a setting operation and a liquid crystal display for displaying, for example, information of the setting operation of the size or type of the sheet and the state of the printer, i.e., the image forming apparatus 50.

The image forming apparatus 50 further includes a control unit 28 that performs an overall control including the control of driving start timing and driving stop timing of the sheet feeding roller 11 and the sheet feeding roller 15, the pair of registration rollers 4, and so forth.

The image forming apparatus 50 has a characteristic of performing the following control, when conveying the sheet to a secondary transfer unit 27, which includes the intermediate transfer belt 3 and the secondary transfer roller 5, in proper timing such that the sheet synchronizes with the image formed by the image forming unit 25. That is, in the image forming apparatus 50, the sheet feeding roller 11 or the sheet feeding roller 15 is driven simultaneously with or prior to the start of driving of the pair of registration rollers 4 to support the start of sheet conveyance by the pair of registration rollers 4, and the driving of the sheet feeding roller 11 or the sheet feeding roller 15 is stopped before the arrival of the leading end of the sheet to the secondary transfer unit 27, to thereby causing the sheet feeding roller 11 or the sheet feeding roller 15 to be rotated (i.e., moved) in accordance with the movement of the sheet.

Figure 2:
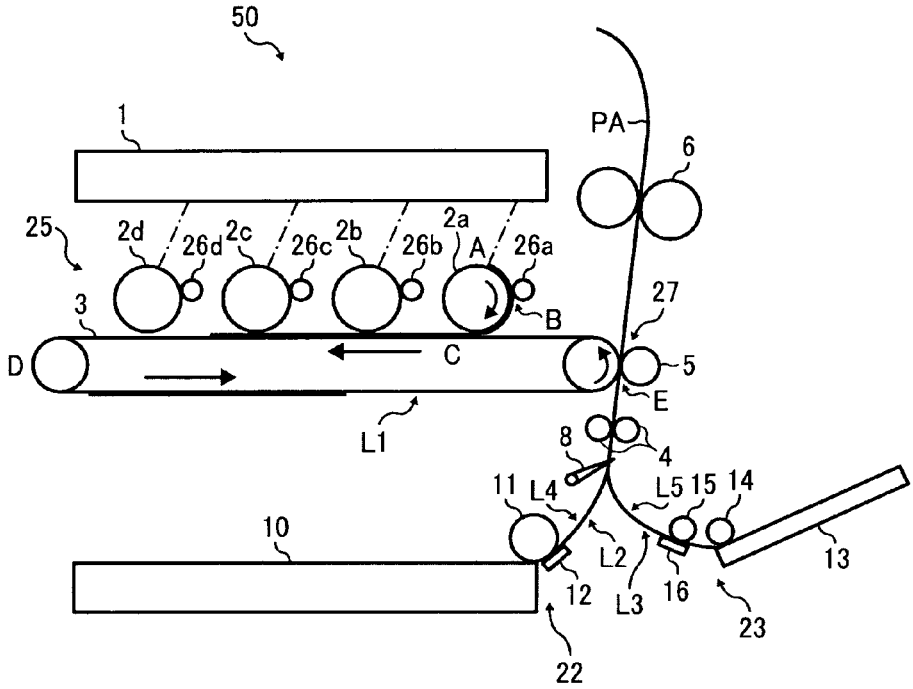
FIG. 2 is a diagram illustrating a detailed configuration and operation of an image forming unit of the image forming apparatus according to Embodiment 1 of the present invention.

With reference to FIG. 2, a detailed configuration and operation of the image forming unit 25 will be described. In FIG. 2, the sheet detection device 18 and the sheet detection device 21 are omitted for clarity of illustration. On the most upstream photoconductor 2*a*, an image is formed in the K color, which serves as the standard color of the image. A point A on the photoconductor 2*a* is applied with laser light by the exposure device 1, and a latent image is formed on the photoconductor 2*a*. At a point B, the latent image is formed into a toner image by the development device 26*a*. At a point C, the toner image is transferred onto the intermediate transfer belt 3, i.e., a primary transfer process is performed.

The intermediate transfer belt 3 is driven to rotate in the counterclockwise direction in FIG. 2, and the toner images of the respective colors are sequentially transferred onto the intermediate transfer belt 3 from the photoconductors 2*b*, 2*c*, and 2*d*. The toner images formed on the intermediate transfer belt 3 reach a point E via a point D. At the point E, the toner images are transferred by the secondary transfer roller 5 onto the sheet conveyed from the pair of registration rollers 4, i.e., a secondary transfer process is performed.

The start of image formation corresponds to the start of exposure, i.e., image writing at the point A on the photoconductor 2*a*. It is now assumed that "L1" represents a length of an image forming pathway or an image forming pathway length in which an image at the point A reaches the point E for the secondary transfer process of the image onto a sheet, i.e., a length including the points A, B, C, D, and E in this order. Further, it is assumed that "L2" represents a partial length of the conveying pathway PA or a partial conveying pathway length in which a sheet is fed from the sheet feeding tray 10 of the sheet feeding unit 22 by the sheet feeding roller 11 and reaches the secondary transfer roller 5 via the pair of registration rollers 4, and that "L3" represents a partial length of the conveying pathway PA or a partial conveying pathway length in which a sheet is fed from the manual sheet feeding tray 13 of the manual sheet feeding unit 23 by the pickup roller 14 and the sheet feeding roller 15 and reaches the secondary transfer roller 5 via the pair of registration rollers 4. In this case, the image forming pathway length L1 is longer than each of the partial conveying pathway lengths L2 and L3. That is, in the image forming apparatus 50, the above-described pathway lengths have relationships L1>L2 and L1>L3.

Further, each of the partial conveying pathway length L2 for sheet feeding and the partial conveying pathway length L3 for manual sheet feeding is shorter than the sheet length. Specifically, the partial conveying pathway length L2 is shorter than at least the conveyance direction length of the maximum size sheet placeable in the sheet feeding tray 10, and the partial conveying pathway length L3 is shorter than at least the conveyance direction length of the maximum size sheet placeable in the manual sheet feeding tray 13. That is, each of the partial conveying pathway lengths L2 and L3 is shorter than at least the conveyance direction length of the maximum usable size sheet.

Figure 3:
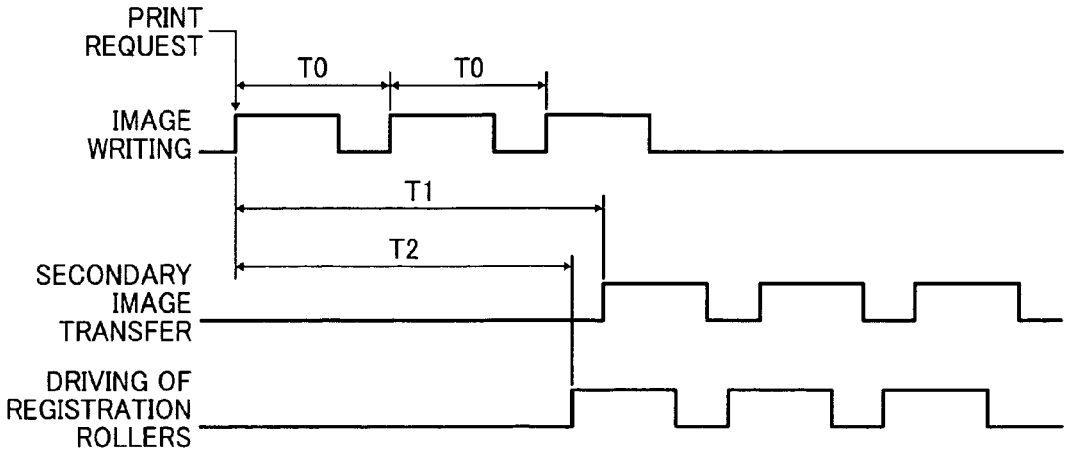
FIG. 3 is a timing chart illustrating control timing of image formation and image transfer to a sheet in a printing operation by the image forming apparatus according to Embodiment 1 of the present invention.

With reference to the timing chart of FIG. 3, a description will be given of control timing of image formation and image transfer to a sheet in a printing operation.

After a predetermined time T1 since the start of image writing at the point A on the photoconductor 2*a*, the toner image on the intermediate transfer belt 3 reaches the point E in FIG. 2, and the secondary transfer of the toner image onto the sheet starts.

To convey the sheet in synchronization with the arrival of the toner image to the point E, the pair of registration rollers 4 is driven after a time T2 since the start of image writing as a trigger. Thus, the sheet in the standby state (hereinafter referred to as the standby sheet) is conveyed to the secondary transfer unit 27, which includes the intermediate transfer belt 3 and the secondary transfer roller 5.

The time T2 is determined based on the image forming pathway length L1, the image forming speed, the conveying pathway length from the pair of registration rollers 4 to the secondary transfer unit 27, and the sheet conveying speed of the pair of registration rollers 4.

In the case of continuous printing on a plurality of sheets, image writing on the second sheet starts after a predetermined time T0 since the start of image writing on the first sheet. Thereafter, the image formation is performed at regular intervals of the time T0.

As for the sheet conveyance, the pair of registration rollers 4 is driven after the time T2 since the start of each image writing operation. Thereby, images are transferred onto sheets by a process similar to the image transfer process of the first sheet.

Figure 4:
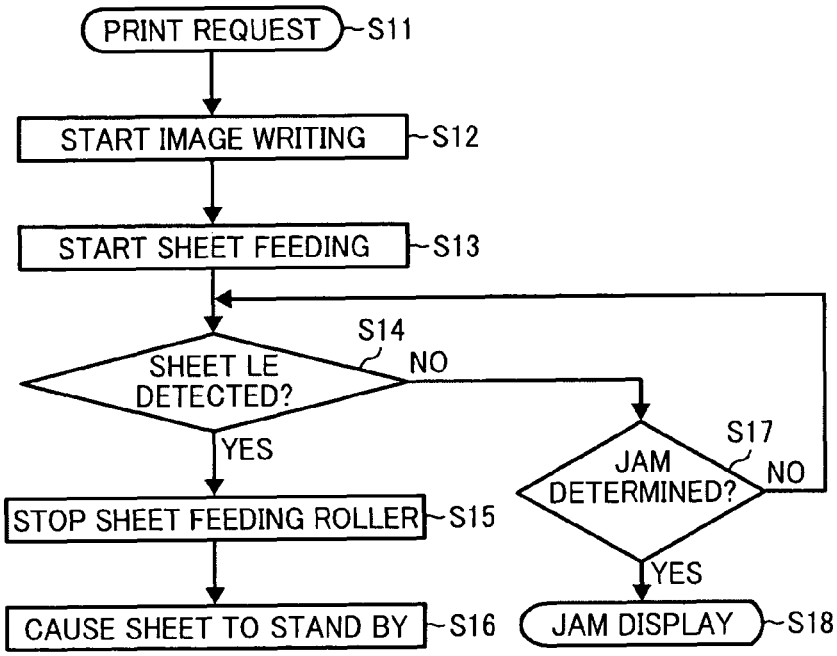
FIG. 4 is a flowchart illustrating a sheet feeding and conveying process from the start of sheet feeding from a sheet feeding unit to the standby at the position of registration rollers in the printing operation by the image forming apparatus according to Embodiment 1 of the present invention.
Figure 5:
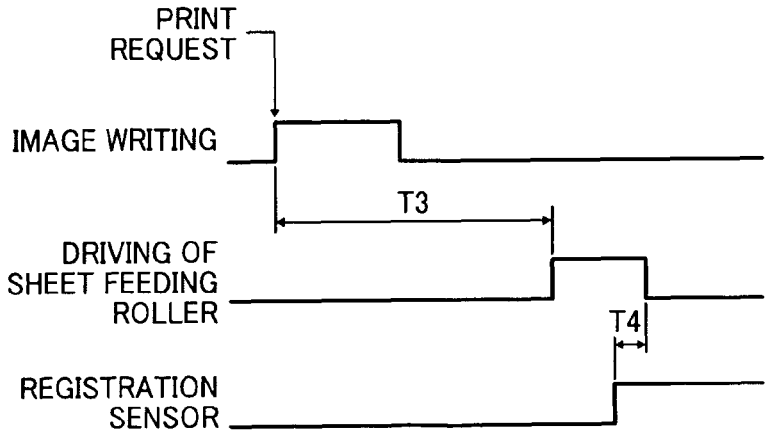
FIG. 5 is a timing chart illustrating sheet feeding and conveying timing from the start of sheet feeding from the sheet feeding unit to the standby at the position of the registration rollers in the printing operation by the image forming apparatus according to Embodiment 1 of the present invention.

With reference to the flowchart of FIG. 4 and the timing chart of FIG. 5, a description will be given of a sheet feeding and conveying process and sheet feeding and conveying timing from the start of sheet feeding from the sheet feeding unit 22 or the manual sheet feeding unit 23 to the standby at the position of the pair of registration rollers 4 in the printing operation.

Upon receipt of a print request from the operation unit 17 (step S11), image writing on the photoconductors 2 starts in the image forming unit 25 (step S12). After a predetermined time T3 since the start of image writing as a trigger, the selected one of the sheet feeding roller 11 of the sheet feeding unit 22 and the sheet feeding roller 15 of the manual sheet feeding unit 23 starts to be driven to supply a sheet from the sheet feeding tray 10 or the manual sheet feeding tray 13 to the pair of registration rollers 4 (step S13). Herein, the time T3 is set for each of the sheet feeding unit 22 and the manual sheet feeding unit 23 as the time combining the time required to convey the sheet by the partial conveying pathway length L2 or L3 from the sheet feeding unit 22 or the manual sheet feeding unit 23 to the secondary transfer roller 5, the time taken for the oblique conveyance correction and standby of the sheet at the pair of registration rollers 4, and a margin time.

After the start of driving of the sheet feeding roller 11 or the sheet feeding roller 15 at step S13, the detection of the leading end of the sheet by the registration sensor 8 is waited for (step S14). Then, after a time T4 since the detection of the leading end of the sheet (YES at step S14), the driving of the sheet feeding roller 11 or 15 is stopped (step S15), and the sheet is caused to stand by at the position of the pair of registration rollers 4 (step S16). Herein, the time T4 is previously set as the time required to move the leading end of the sheet to the pair of registration rollers 4 and flex the sheet for the oblique conveyance correction. Normally, the amount of flexure for the oblique conveyance correction is set to approximately 2 mm to approximately 4 mm in many cases. Alternatively, the time T4 may be set such that the leading end of the sheet stops in front of the pair of registration rollers 4. In this case, when the standby sheet is conveyed to the secondary transfer unit 27, the driving of the sheet feeding roller 11 or the sheet feeding roller 15 is started at a preset time before the start of driving of the pair of registration rollers 4 such that the sheet conveyance by the pair of registration rollers 4 is performed after the sheet is abutted against and flexed by the pair of registration rollers 4 to correct the oblique conveyance of the sheet.

Each of the partial conveying pathway lengths L2 and L3 is shorter than the sheet length. Therefore, the trailing end of the sheet standing by at the position of the pair of registration rollers 4 is located in the sheet feeding tray 10 or the manual sheet feeding tray 13, and the standby sheet is gripped by the sheet feeding roller 11 or the sheet feeding roller 15.

From the start of driving of the sheet feeding roller 11 or the sheet feeding roller 15 at step S13 to a predetermined time, the monitoring at step S14 for detection of the leading end of the sheet by the registration sensor 8 is performed, i.e., jam determination of whether or not a jam has occurred is performed (step S17). If the leading end of the sheet is not detected by the predetermined time (YES at step S17), it is determined that a sheet feeding and conveyance failure has occurred, and the image formation by the image forming unit 25 and the driving of the sheet feeding roller 11 of the sheet feeding unit 22 or the sheet feeding roller 15 of the manual sheet feeding unit 23 are stopped. Further, a message indicating the occurrence of a sheet feeding jam, such as "SHEET MISFEED," is displayed on the operation unit 17, i.e., jam display is performed (step S18).

The timing of the jam determination at step S17 is set for each of the sheet feeding unit 22 and the manual sheet feeding unit 23 as the timing in consideration of the time required to convey the sheet from the sheet feeding unit 22 or the manual sheet feeding unit 23 to the registration sensor 8, variations in the detection by the registration sensor 8, and a conveyance margin.

Figure 6:
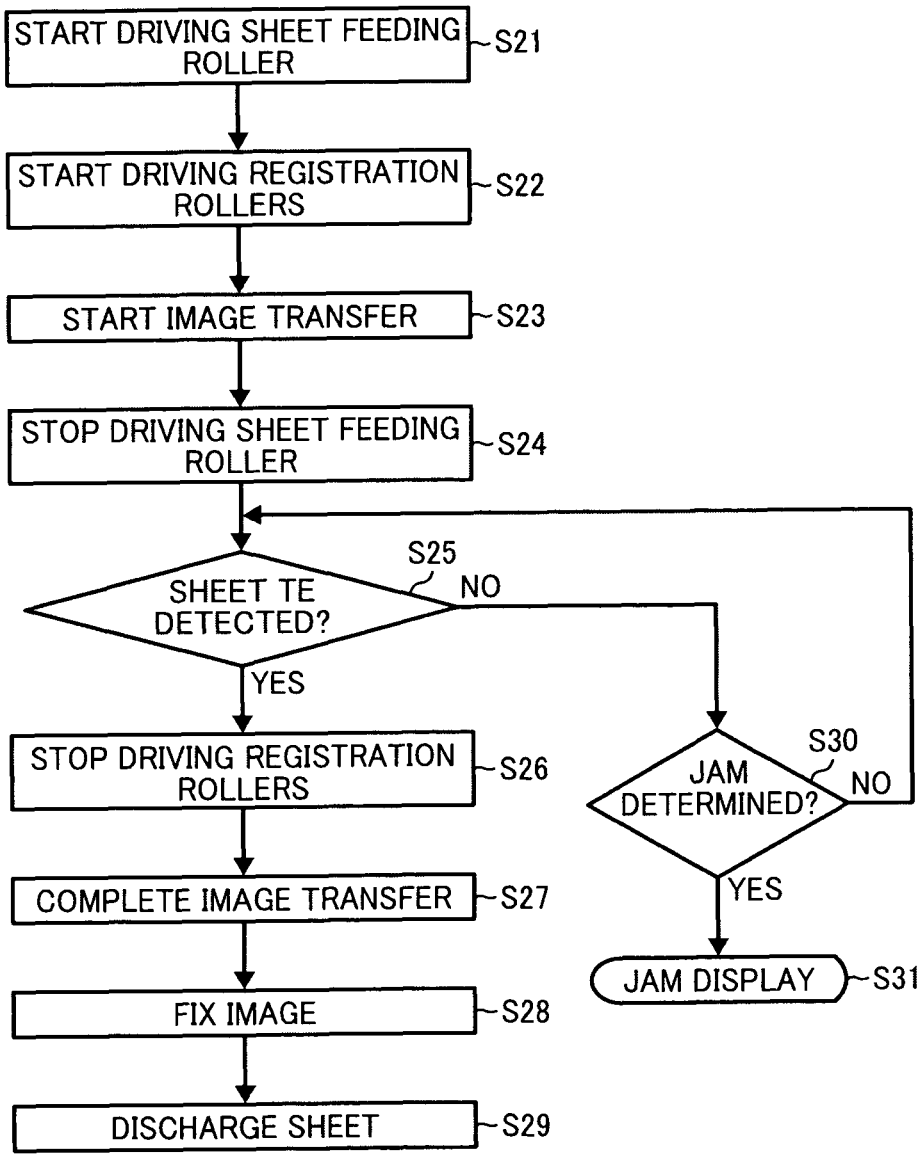
FIG. 6 is a flowchart illustrating a sheet conveying process according to a comparative example of a control method for recording an image on a sheet standing by at the position of the registration rollers in the image forming apparatus according to Embodiment 1 of the present invention.
Figure 7:
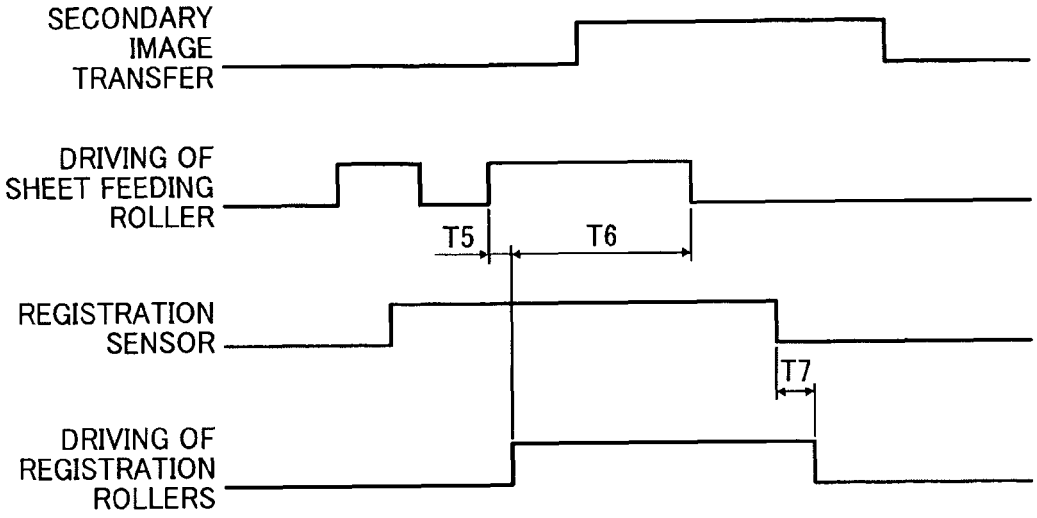
FIG. 7 is a timing chart illustrating sheet conveying timing according to the comparative example of the control method for recording an image on a sheet standing by at the position of the registration rollers in the image forming apparatus according to Embodiment 1 of the present invention.

With reference to the flowchart of FIG. 6 and the timing chart of FIG. 7, a description will be given of a sheet conveying process and sheet conveying timing according to a comparative example of a control method for recording an image on a sheet standing by at the position of the pair of registration rollers 4.

The sheet feeding roller 11 or 15 starts to be driven (step S21), and the pair of registration rollers 4 start to be driven in synchronization with the image formed by the image forming unit 25, as described above (step S22). Thereby, the sheet standing by at the position of the pair of registration rollers 4 is conveyed to the secondary transfer unit 27, which includes the intermediate transfer belt 3 and the secondary transfer roller 5, and the image transfer starts (step S23).

At steps S21 and S22, the sheet feeding roller 11 or the sheet feeding roller 15 starts to be driven simultaneously with the start of driving of the pair of registration rollers 4 or before a time T5 to assist the sheet conveyance from the upstream side in the sheet conveyance direction. This is for starting the sheet conveyance without a delay from the start of driving of the pair of registration rollers 4.

If the sheet feeding roller 11 or the sheet feeding roller 15 is not driven, the pair of registration rollers 4 fails to reliably grip the leading end of the standby sheet. The failure results in a delay in the sheet conveyance to the secondary transfer unit 27 and a shift in position of the leading end of the image. The undesirable shift in position of the leading end of the image tends to occur particularly in a relatively thick sheet due to, for example, difficulty for the pair of registration rollers 4 in gripping the leading end of a thick sheet and an increase in a sheet conveying load.

In the case in which the sheet having reached the pair of registration rollers 4 is flexed for the oblique conveyance correction and caused to stand by, the time T5 is set as the time for assisting the sheet conveyance. By contrast, in the case in which the sheet is caused to stop and stand by in front of the pair of registration rollers 4, the time T5 is set as the time required to abut the leading end of the sheet against the pair of registration rollers 4 and to flex the sheet for the oblique conveyance correction, as described above.

According to the comparative example of the control method, after the driving of the pair of registration rollers 4, the driving of the sheet feeding roller 11 or 15 is stopped when the trailing end of the sheet has passed the sheet feeding roller 11 of the sheet feeding unit 22 or the sheet feeding roller 15 of the manual sheet feeding unit 23 after a time T6 since the start of driving of the pair of registration rollers 4 as a trigger (step S24).

Herein, the value of the time T6 is determined for each of the sheet feeding unit 22 and the manual sheet feeding unit 23 in accordance with the sheet length. The sheet length is determined by the sheet size set by a user through the operation unit 17 or a printer driver.

Each of the partial conveying pathway length L2 from the sheet feeding unit 22 to the secondary transfer unit 27 and the partial conveying pathway length L3 from the manual sheet feeding unit 23 to the secondary transfer unit 27 is shorter than the sheet length. According to the comparative example of the control method, therefore, the driving stop timing of the sheet feeding roller 11 or the sheet feeding roller 15 is during the secondary transfer of the image onto the sheet.

If the driving of the sheet feeding roller 11 or the sheet feeding roller 15 is stopped before the trailing end of the sheet passes the sheet feeding roller 11 or the sheet feeding roller 15, the sheet conveying load changes at the driving stop timing of the sheet feeding roller 11 or the sheet feeding roller 15. Therefore, the sheet conveying speed in the secondary transfer unit 27 temporarily changes, and an image failure, such as shock jitter, is caused. Therefore, the time T6 is set to the time at which the trailing end of the sheet has reliably passed the sheet feeding roller 11 or the sheet feeding roller 15.

As for the driving stop timing of the pair of registration rollers 4, the pair of registration rollers 4 are stopped when the trailing end of the sheet has passed the pair of registration rollers 4 after a time T7 since the detection of the trailing end of the sheet by the registration sensor 8 (YES at step S25) as a trigger (step S26). Thereafter, the image transfer is completed (step S27). Then, the image is fixed on the sheet (step S28), and the sheet is discharged (step S29).

Herein, the value of the time T7 is set based on the sheet conveyance time elapsed from the detection of the trailing end of the sheet by the registration sensor 8 to the arrival of the trailing end of the sheet to the pair of registration rollers 4 and a sheet conveyance margin.

From the start of driving of the pair of registration rollers 4 to a time determined for each sheet length, the monitoring for detection of the trailing end of the sheet by the registration sensor 8 (step S25) is performed, i.e., jam determination of whether or not a jam has occurred is performed (step S30). If the trailing end of the sheet is not detected by the predetermined time (NO at step S25 and YES at step S30), it is determined that a sheet feeding and conveyance failure has occurred, and the image formation by the image forming unit 25 of the image forming apparatus 50 and the driving of the pair of registration rollers 4 are stopped. Further, a message indicating the occurrence of a sheet conveyance jam, such as "SHEET MISFEED," is displayed on the operation unit 17, i.e., jam display is performed (step S31). The timing of the jam determination is determined by the sheet size set by the user.

TABLE 1 is for explaining the jam determination according to the comparative example of the control method performed when the user-set sheet size is different from the actually set sheet size.

TABLE 1

| | | | ACTUALLY SET SHEET SIZE | | | | |
|---|---|---|---|---|---|---|---|
| | | LENGTH (mm) | A6 148 | B6 182 | A5 210 | B5 257 | A4 297 |
| USER-SET SHEET SIZE | A6 | 148 | A | B | B | B | B |
| | B6 | 182 | D | A | B | B | B |
| | A5 | 210 | C | D | A | B | B |
| | B5 | 257 | C | C | D | A | B |
| | A4 | 297 | E | C | C | D | A |

In TABLE 1, "A" indicates that the sheet conveyance is normally performed. Further, "B" indicates that the sheet conveyance jam is detected with no turn-off of the registration sensor 8, and "C" indicates that the sheet conveyance jam is detected with no turn-off of the registration sensor 8 and with two sheets conveyed. Further, "D" indicates that the sheet conveyance jam is not detected with the second sheet fed halfway, and "E" indicates that the sheet conveyance jam is not detected with two sheets conveyed.

The time T6, in which the sheet feeding roller 11 or the sheet feeding roller 15 is driven, and the jam (i.e., sheet conveyance jam) determination based on the detection of the trailing end of the sheet by the registration sensor 8 are controlled based on the user-set sheet size. Therefore, if the size of the sheet actually set in the sheet feeding tray 10 or the manual sheet feeding tray 13, i.e., the actually set sheet size is different from the sheet size set by the user through the operation unit 17, i.e., the user-set sheet size, normal sheet conveyance is prevented.

The image forming apparatus 50 according to the Embodiment 1, which is configured as a small-sized printer, is set to convey the sheet in the long side direction of the sheet, with a short side of the sheet set as the leading end. TABLE 1 shows results of jam determination according to the comparative example of the control method based on the detection of the trailing end of the sheet by the registration sensor 8. The table illustrates the results for respective combinations of the user-set sheet sizes and the sizes of the sheets actually set in the sheet feeding tray 10 or the manual sheet feeding tray 13.

If the conveyance direction length of the actually set sheet is longer than the conveyance direction length the user-set sheet size, the registration sensor 8 does not detect the trailing end of the sheet by the predetermined time, and thus the sheet conveyance jam is detected, as indicated by "B" in TABLE 1.

If the conveyance direction length of the actually set sheet is shorter than the conveyance direction length of the user-set sheet size, the second sheet is also fed from the sheet feeding tray 10 or the manual sheet feeding tray 13 during the time T6, in which the sheet feeding roller 11 or the sheet feeding roller 15 is driven. In this case, the jam determination result varies, depending on the combination of the user-set sheet size and the actually set sheet size.

In the combinations indicated by "D" in TABLE 1, the driving of the sheet feeding roller 11 or the sheet feeding roller 15 is stopped before the leading end of the second sheet reaches the registration sensor 8. Therefore, the detection of the trailing end of the sheet by the registration sensor 8 is normally performed, and the sheet conveyance jam is not detected.

By contrast, in the combinations indicated by "C" in TABLE 1, the leading end of the second sheet reaches the registration sensor 8 before the driving of the sheet feeding roller 11 or the sheet feeding roller 15 is stopped, and the first and second sheets behave as a single sheet, the length of which corresponds to the sum of the lengths of two actually set sheets. Therefore, the registration sensor 8 does not detect the trailing end of the sheet by the predetermined time, and thus the sheet conveyance jam is detected.

In the combination indicated by "E" in TABLE 1, the first and second sheets behave as a single sheet, the length of which corresponds to the sum of the lengths of two actually set sheets, similarly as in the combinations indicated by "C". However, the sum of the lengths of two actually set sheets corresponds to the user-set sheet size. In the jam determination based on the detection of the trailing end of the sheet by the registration sensor 8, therefore, it is determined that the sheet conveyance is normally performed, and thus the sheet conveyance jam is not detected.

In the combinations indicated by "B" and "D" in TABLE 1, it is possible to detect the conveyance direction length of the actually set sheet based on the information of the detection of the sheet trailing end by the registration sensor 8, as described later. In the combinations indicated by "C" and "E" in TABLE 1, however, the correct sheet length is not detected, and the actually set sheet is detected as longer than the sheet actually is.

In both the jam determination based on the sheet detection information provided by the registration sensor 8 and the detection of the conveyance direction length of the sheet, the second sheet may be wasted, depending on the combination of the user-set sheet size and the actually set sheet size.

In view of the above, the image forming apparatus 50 according to Embodiment 1 controls the sheet conveyance in the following manner.

Figure 8:
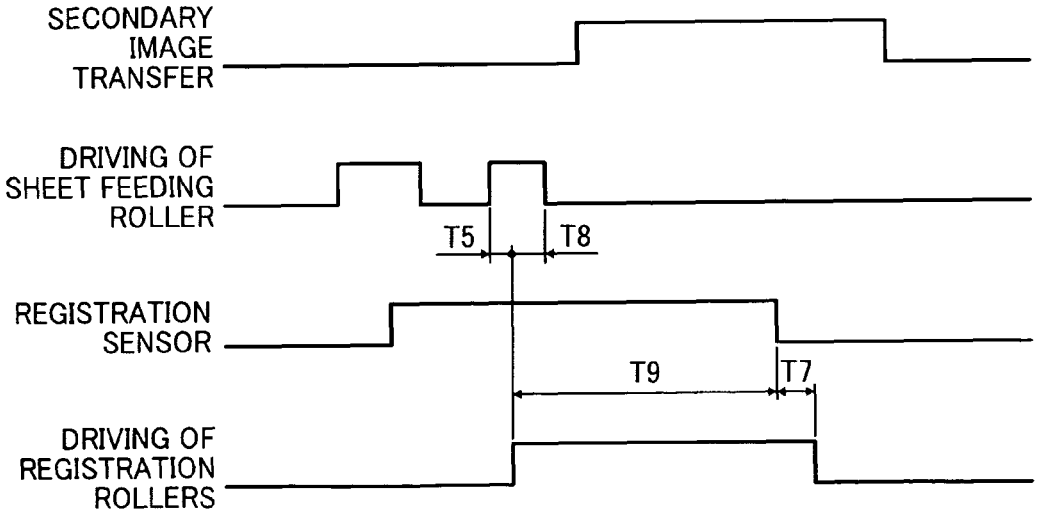
FIG. 8 is a timing chart illustrating timing according to a control method of an embodiment of the present invention for conveying to a secondary transfer unit a sheet standing by at the position of the registration rollers in the image forming apparatus according to Embodiment 1 of the present invention.

With reference to the timing chart of FIG. 8, a description will be given of the timing according to the control method of Embodiment 1 for conveying the sheet standing by at the position of the pair of registration rollers 4 to record an image on the sheet, i.e., the control timing of the conveyance of the standby sheet to the secondary transfer unit 27.

The pair of registration rollers 4 start to be driven in synchronization with the image formed by the image forming unit 25, and the sheet standing by at the position of the pair of registration rollers 4 is conveyed to the secondary transfer unit 27, which includes the intermediate transfer belt 3 and the secondary transfer roller 5.

The control method of Embodiment 1 is similar to the comparative example of the control method in assisting the sheet conveyance from the upstream side in the sheet conveyance direction by starting the driving of the sheet feeding roller 11 or the sheet feeding roller 15 simultaneously with the start of driving of the pair of registration rollers 4 or before the time T5 to start the sheet conveyance without a delay from the start of driving of the pair of registration rollers 4.

After the pair of registration rollers 4 is driven and the standby sheet starts to be conveyed, the driving of the sheet feeding roller 11 or the sheet feeding roller 15 is stopped before the leading end of the sheet reaches the secondary transfer unit 27. Specifically, the driving of the sheet feeding roller 11 or the sheet feeding roller 15 is stopped after a time T8 since the start of driving of the pair of registration rollers 4 as a trigger.

The value of the time T8 is determined by the sheet conveyance distance by which the sheet is conveyed from the pair of registration rollers 4 until the stop of driving of the sheet feeding roller 11 or the sheet feeding roller 15 and the sheet conveying speed of the pair of registration rollers 4, and is set as a constant value irrespective of the sheet length and whether the sheet feeding source is the sheet feeding unit 22 or the manual sheet feeding unit 23.

The sheet conveyance distance by which the sheet is conveyed until the stop of driving of the sheet feeding roller 11 or the sheet feeding roller 15 is set such that the leading end of the sheet conveyed by the sheet conveyance distance is located at, for example, an intermediate point on the conveying pathway PA from the pair of registration rollers 4 to the secondary transfer unit 27.

The sheet conveyance distance until the stop of driving of the sheet feeding roller 11 or the sheet feeding roller 15 can be freely set, as long as the leading end of the sheet conveyed by the sheet conveyance distance does not reach the secondary transfer unit 27, in consideration of the sheet conveyance assisting function at the start of driving of the pair of registration rollers 4, variations in the time required to stop the driving of the sheet feeding roller 11 or the sheet feeding roller 15, and so forth.

After the driving of the sheet feeding roller 11 or the sheet feeding roller 15 is stopped, the sheet is conveyed by the pair of registration rollers 4, and the sheet feeding roller 11 or the sheet feeding roller 15 is rotated in accordance with the movement of the sheet.

If the sheet feeding roller 11 or the sheet feeding roller 15 transmits the drive via a one-way clutch or is drive-connected to an electromagnetic clutch, as in an existing configuration, it is possible to substantially reduce load torque against the rotation of the sheet feeding roller 11 or the sheet feeding roller 15 according to the movement of the sheet. Therefore, there is little variation in the sheet conveying load during the secondary transfer of the image onto the sheet, and an image failure such as shock jitter does not occur in the secondary transfer unit 27.

Further, after the trailing end of the sheet passes the sheet feeding roller 11 or the sheet feeding roller 15, the rotation of the sheet feeding roller 11 or the sheet feeding roller 15 is stopped. Therefore, the feeding of the second sheet is prevented.

It is now assumed that "L4" represents a partial length of the conveying pathway PA or a partial conveying pathway length from the sheet feeding roller 11 to the sheet feeding roller driving stop point via the pair of registration rollers 4, and that "L5" represents a partial length of the conveying pathway PA or a partial conveying pathway length from the sheet feeding roller 15 for manual sheet feeding to the sheet feeding roller driving stop point via the pair of registration rollers 4. In this case, each of the partial conveying pathway lengths L4 and L5 is shorter than the conveyance direction length of the minimum size sheet placeable in the corresponding one of the sheet feeding tray 10 and the manual sheet feeding tray 13. Regardless of the combination of the user-set sheet size and the actually set sheet size, therefore, the driving of the sheet feeding roller 11 or the sheet feeding roller 15 is stopped before the trailing end of the actually set sheet passes the sheet feeding roller 11 or the sheet feeding roller 15. Consequently, the feeding of the second sheet is reliably prevented.

According to the control method of Embodiment 1, the driving stop timing of the sheet feeding roller 11 or the sheet feeding roller 15 is independent of the sheet size. Even if the user-set sheet size is different from the actually set sheet size, therefore, a single sheet is fed and conveyed from the sheet feeding unit 22 or the manual sheet feeding unit 23. Accordingly, the second sheet is prevented from being fed and wasted.

As for the stop of driving of the pair of registration rollers 4, the pair of registration rollers 4 is stopped when the trailing end of the sheet has passed the pair of registration rollers 4 after the time T7 since the actual detection of the trailing end of the sheet by the registration sensor 8 as a trigger.

According to the control method of Embodiment 1, therefore, even if the user-set sheet size is different from the actually set sheet size, it is possible to detect the conveyance direction length of the actually set sheet based on a time T9 elapsed from the start of driving of the pair of registration rollers 4 to the detection of the trailing end of the sheet by the registration sensor 8, the sheet conveying speed of the pair of registration rollers 4, and the sheet conveyance distance from the sheet trailing end detection position of the registration sensor 8 to the pair of registration rollers 4.

With reference to the flowchart of FIG. 9, a description will be given of a process of sheet conveyance control and sheet size mismatch determination according to Embodiment 1.

The control method of Embodiment 1 allows the detection of the conveyance direction length of the actually set sheet based on the sheet trailing end detection time of the registration sensor 8. If the print size of the image to be printed by the user is different from the size of the sheet actually set in the sheet feeding tray 10 or the manual sheet feeding tray 13, therefore, it is possible to issue a size mismatch warning for notifying the user of the difference in sheet size.

Figure 9:
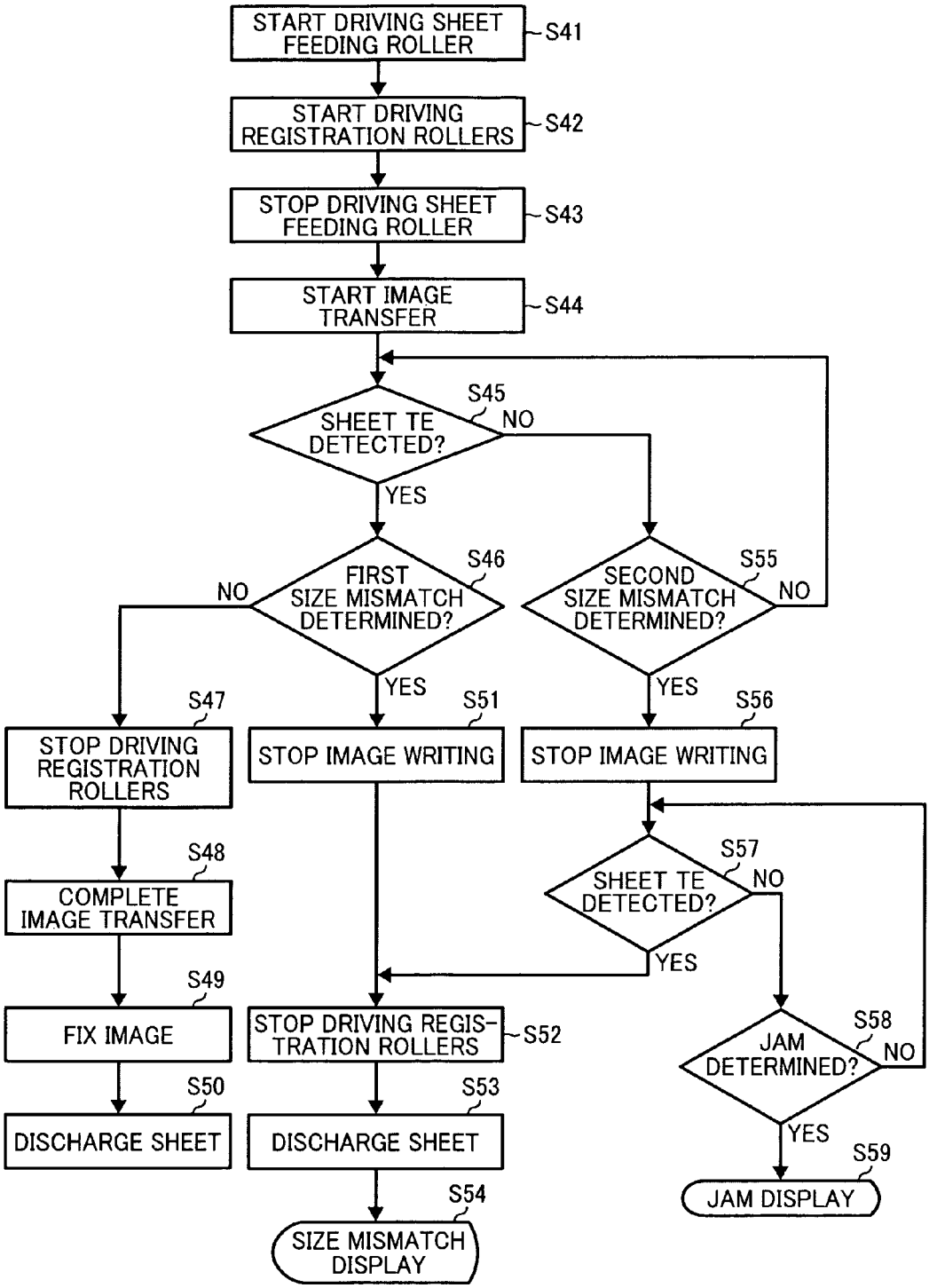
FIG. 9 is a flowchart illustrating a process of conveyance control and sheet size mismatch determination in the image forming apparatus according to Embodiment 1 of the present invention.

FIG. 9 is a flowchart for explaining a procedure of issuing the size mismatch warning, illustrating steps from the start of conveyance of the sheet standing by at the position of the pair of registration rollers 4 to the secondary transfer unit 27.

The sheet feeding roller 11 or the sheet feeding roller 15 starts to be driven (step S41), and the pair of registration rollers 4 start to be driven (step S42). Thereafter, the driving of the sheet feeding roller 11 or the sheet feeding roller 15 is stopped (step S43), and the image transfer to the sheet starts (step S44). The registration sensor 8 performs monitoring for detection of the trailing end of the sheet from the start of driving of the pair of registration rollers 4 to a predetermined time determined by the conveyance direction length of the print size of the image (step S45).

If the trailing end of the sheet is detected (YES at step S45), the first size mismatch determination is performed (step S46). In the first size mismatch determination, the length of the conveyed sheet is calculated from the time elapsed from the start of driving of the pair of registration rollers 4 to the detection of the trailing end of the sheet, and the result of calculation is compared with the conveyance direction length of the print size of the image.

If it is determined as the determination result of the first size mismatch determination that the sheet size is normal (NO at step S46), the driving of the pair of registration rollers 4 is stopped in accordance with the sheet trailing end detection time (step S47), and the image transfer is completed (step S48). Then, the image is fixed on the sheet (step S49), and the sheet is discharged (step S50). Thereby, the printing operation is normally completed.

By contrast, if it is determined in the first size mismatch determination at step S46 that the calculation result of the length of the conveyed sheet is shorter than the conveyance direction length of the print size of the image (YES at step S46), the image writing is immediately stopped (step S51). Then, the driving of the pair of registration rollers 4 is stopped (step S52), and the sheet is discharged (step S53). Thereafter, size mismatch display is performed (step S54). If a continuous printing process is being performed when the determination result of the first size mismatch determination at step S46 is YES, the printing process is interrupted, and the size mismatch handling process of steps S52 to S54 is performed.

As for the sheet conveyance, the sheet being conveyed is subjected to conveyance control in accordance with the calculated sheet length, and the discharge of the sheet onto the sheet discharging tray 24 is completed to leave no sheet inside the image forming apparatus 50.

In the size mismatch display at step S54, a message such as "WRONG SHEET SIZE" is displayed on, for example, the operation unit 17 to alert and warn the user that the print size of the image does not match the actually set sheet size.

At step S45, if the trailing end of the sheet is not detected by the registration sensor 8 by the sheet trailing end detection time set based on the conveyance direction length of the print size of the image (NO at step S45), the second size mismatch determination is performed (step S55). If it is determined in the second size mismatch determination that the conveyance direction length of the actually set sheet is longer than the conveyance direction length of the print size of the image (YES at step S55), the image writing is immediately stopped (step S56), and the size mismatch handling process of steps S52 to S54 is performed.

In the second size mismatch determination, the size mismatch is determined, i.e., it is determined that the length of the actually set sheet is longer than the length of the print size of the image before the registration sensor 8 detects the trailing end of the sheet. Therefore, the second size mismatch determination is different from the first size mismatch determination in that the conveyance direction length of the actually set sheet has not been confirmed at the time of determination of the size mismatch.

After transition to the size mismatch handling process, the registration sensor 8 continues the monitoring for detection of the trailing end of the sheet (step S57), and the length of the conveyed sheet is calculated from the sheet trailing end detection time.

The second size mismatch determination is similar to the first size mismatch determination in that, after the detection of the trailing end of the sheet, the conveyance control is performed in accordance with the calculated sheet length and the discharge of the sheet onto the sheet discharging tray 24 is completed to leave no sheet inside the image forming apparatus 50.

When the length of the conveyed sheet is longer than the length of the print size of the image, the size mismatch determination is thus performed before the confirmation of the length of the conveyed sheet. This configuration has an effect of allowing a prompt shift to the size mismatch handling process and substantially suppressing unnecessary image formation on the intermediate transfer belt 3 in, for example, a continuous printing operation.

With the first and second size mismatch determinations thus performed, in the event of a setting error due to the mismatch between the print size of the image and the actually set sheet size, it is possible to substantially suppress the occurrence of a print error by interrupting the printing process and issuing a warning to the user.

Further, the control method of Embodiment 1 discharges the sheet onto the sheet discharging tray 24 without causing a sheet conveyance jam, unlike the comparative example of the control method. Therefore, Embodiment 1 has an effect of not requiring, for example, a process of handling the sheet jammed in the image forming apparatus 50.

If the trailing end of the sheet is not detected by the registration sensor 8 after the transition to the size mismatch handling process according to the second size mismatch determination (NO at step S57), the jam determination is performed in accordance with the maximum sheet length set for each of the sheet feeding unit 22 and the manual sheet feeding unit 23 (step S58).

If the trailing end of the sheet is not detected by the registration sensor 8 by the sheet trailing end detection time set based on the set maximum sheet length, it is determined that a sheet conveyance failure has occurred, and the sheet conveyance driving is stopped. Further, a message indicating the occurrence of a sheet conveyance jam is displayed on the operation unit 17, i.e., jam display is performed (step S59).

With the jam determination thus performed in accordance with the maximum sheet length, the image forming apparatus 50 is prevented from being damaged by, for example, a sheet jam or an operation failure other than the setting error due to the mismatch between the print size of the image and the actually set sheet size.

As described above, in the image forming apparatus 50, when the sheet starts to be conveyed from the pair of registration rollers 4 to the secondary transfer unit 27, the sheet feeding roller 11 or the sheet feeding roller 15 is driven to support the sheet conveyance from the upstream side, and the driving of the sheet feeding roller 11 or the sheet feeding roller 15 is stopped before the leading end of the sheet reaches the secondary transfer unit 27 such that the sheet feeding roller 11 or the sheet feeding roller 15 is rotated in accordance with the movement of the sheet. Therefore, there is no delay in the sheet conveyance when the pair of registration rollers 4 starts to be driven, and a shift in position of the leading end of the image is prevented. Further, there is no change in the load on the upstream side in the sheet conveyance direction during the image recording, and an image failure such as shock jitter is not caused.

In the image forming apparatus 50, if the conveyance direction length of the actually set sheet is shorter than the conveyance direction length of the user-set sheet size, the driving of the sheet feeding roller 11 or the sheet feeding roller 15 is stopped before the second sheet is fed and conveyed. Therefore, the second sheet is prevented from being fed and wasted. Further, the registration sensor 8 provided in front of the pair of registration rollers 4 can detect the actual sheet length.

Therefore, the image forming apparatus 50, which is configured as a small-sized full-color printer, can be provided as a small-sized and low-cost image forming apparatus having effects of preventing a shift in position of the image and an image failure such as shock jitter, and preventing the feeding and conveyance of the second sheet and resultant unnecessary waste of a sheet, even if the actually set sheet size is different from the user-set sheet size and the conveyance direction length of the actually set sheet is shorter than the conveyance direction length of the user-set sheet size.

Further, the actual sheet length is detected from the sheet trailing end detection time of the registration sensor 8 provided between the sheet feeding rollers 11 and 15 and the pair of registration rollers 4. Further, if the length of the user-set sheet size is different from the detected sheet length, the image forming operation is stopped, and a warning is issued. Accordingly, there is no need to perform an operation such as a jam handing process.

As described above, the image forming apparatus 50 according to Embodiment 1 includes the secondary transfer unit 27 for recording an image on a sheet, the pair of registration rollers 4 for conveying the sheet to the secondary transfer unit 27, the sheet feeding rollers 11 and 15 for supplying the sheet to the pair of registration rollers 4, and the control unit 28 for controlling the driving of the pair of registration rollers 4 and the sheet feeding rollers 11 and 15. In the image forming apparatus 50, the partial conveying pathway lengths L2 and L3 from each of the sheet feeding rollers 11 and 15, respectively, to the secondary transfer unit 27 is shorter than the conveyance direction length of the maximum usable size sheet. Further, when the leading end of the sheet is located between the pair of registration rollers 4 and the secondary transfer unit 27 after the start of driving of the pair of registration rollers 4 to convey the sheet to the secondary transfer unit 27, the control unit 28 switches the sheet feeding roller 11 or the sheet feeding roller 15 from the driven state to the non-driven state to cause the sheet feeding roller 11 or the sheet feeding roller 15 to be moved by the sheet conveyed by the pair of registration rollers 4.

With this configuration, when the sheet starts to be conveyed from the pair of registration rollers 4 (i.e., a conveying device) to the secondary transfer unit 27 (i.e., a recording unit), the sheet feeding roller 11 or the sheet feeding roller 15 (i.e., a feeding device) is driven to support the sheet conveyance by the pair of registration rollers 4 from the upstream side, and the driving of the sheet feeding roller 11 or the sheet feeding roller 15 is stopped before the leading end of the sheet reaches the secondary transfer unit 27 such that the sheet feeding roller 11 or the sheet feeding roller 15 is rotated in accordance with the movement of the sheet. Therefore, there is no delay in the sheet conveyance when the pair of registration rollers 4 starts to be driven, and a shift in position of the leading end of the image is prevented. Further, there is no change in the load on the upstream side in the sheet conveyance direction during the image recording in the secondary transfer unit 27, and an image failure such as shock jitter is not caused.

Further, if the conveyance direction length of the actually set sheet is shorter than the conveyance direction length of the user-set sheet size, the driving of the sheet feeding roller 11 or the sheet feeding roller 15 is stopped before the second sheet is fed and conveyed. Therefore, the second sheet is prevented from being fed and wasted.

Therefore, it is possible to provide a small-sized and low-cost image forming apparatus that prevents the waste of the second sheet, a shift in position of the image, and an image failure such as and shock jitter, even if the actually set sheet size is different from the user-set sheet size and the conveyance direction length of the actually set sheet is shorter than the conveyance direction length of the user-set sheet size.

Further, in the image forming apparatus 50 according to Embodiment 1, each of the sheet feeding rollers 11 and 15 is for separating and feeding a single sheet from the corresponding one of the sheet feeding tray 10 and the manual sheet feeding tray 13 storing a plurality of stacked sheets, and the conveying pathway PA between the sheet feeding roller 11 and the pair of registration rollers 4 and the conveying pathway PA between the sheet feeding roller 15 and the pair of registration rollers 4 is not provided with or lacks a device for conveying the sheet.

With this configuration, it is possible to provide a small-sized and low-cost image forming apparatus that prevents the waste of the second sheet, a shift in position of the image, and an image failure such as and shock jitter, even if the actually set sheet size is different from the user-set sheet size and the conveyance direction length of the actually set sheet is shorter than the conveyance direction length of the user-set sheet size.

Further, in the image forming apparatus 50 according to Embodiment 1, when the sheet feeding roller 11 or the sheet feeding roller 15 is switched from the driven state to the non-driven state after the start of driving of the pair of registration rollers 4 to convey the sheet supplied by the sheet feeding roller 11 or the sheet feeding roller 15 to the secondary transfer unit 27, the conveying pathway length between the position of the leading end of the sheet and the sheet feeding roller 11 or the sheet feeding roller 15 is shorter than the conveyance direction length of the minimum usable size sheet.

With this configuration, it is possible to provide a small-sized and low-cost image forming apparatus that prevents the waste of the second sheet, a shift in position of the image, and an image failure such as shock jitter, even if the actually set sheet size is different from the user-set sheet size and the conveyance direction length of the actually set sheet is shorter than the conveyance direction length of the user-set sheet size.

Further, in the image forming apparatus 50 according to Embodiment 1, the registration sensor 8 that detects a sheet is provided between the sheet feeding rollers 11 and 15 and the pair of registration rollers 4. Based on the sheet detection information provided by the registration sensor 8, the control unit 28 stops the driving of the sheet feeding roller 11 or the sheet feeding roller 15 such that the sheet is stopped in front of the pair of registration rollers 4 or abutted against and stopped by the pair of registration rollers 4. Then, after the lapse of a predetermined time since the start of driving of the sheet feeding roller 11 or the sheet feeding roller 15 or the start of driving of the pair of registration rollers 4 to convey the sheet to the secondary transfer unit 27, the control unit 28 switches the sheet feeding roller 11 or the sheet feeding roller 15 from the driven state to the non-driven state.

With this configuration, the driving of the sheet feeding roller 11 or the sheet feeding roller 15 is controlled based on the sheet detection information provided by the registration sensor 8.

Further, in the image forming apparatus 50 according to Embodiment 1, the control unit 28 detects the conveyance direction length of the sheet based on the sheet detection information provided by the registration sensor 8.

With this configuration, even if the user-set sheet size is different from the actually set sheet size, it is possible to detect the conveyance direction length of the actually set sheet based on the time elapsed from the start of driving of the pair of registration rollers 4 to the detection of the trailing end of the sheet by the registration sensor 8, the sheet conveying speed of the pair of registration rollers 4, and the sheet conveyance distance from the sheet trailing end detection position of the registration sensor 8 to the pair of registration rollers 4.

Further, in the image forming apparatus 50 according to Embodiment 1, the control unit 28 determines whether or not the conveyance direction length of the sheet detected based on the sheet detection information provided by the registration sensor 8 matches the conveyance direction length of the image to be recorded on the sheet. Further, if the conveyance direction length of the sheet does not match the conveyance direction length of the image, the control unit 28 performs the sheet size mismatch handling process and issues the warning of the size mismatch.

With this configuration performing the sheet size mismatch handling process and the warning issuance, the occurrence of a sheet conveyance jam is prevented, and there is no need to perform an operation such as a jam handing process.

Further, in the image forming apparatus 50 according to Embodiment 1, if it is determined that the conveyance direction length of the sheet detected based on the sheet detection information provided by the registration sensor 8 is longer than the conveyance direction length of the image to be recorded on the sheet, the control unit 28 performs the sheet size mismatch handling process and the warning issuance.

With this configuration performing the sheet size mismatch handling process and the warning issuance, the occurrence of a sheet conveyance jam is prevented, and there is no need to perform an operation such as a jam handing process.

Further, in the image forming apparatus 50 according to Embodiment 1, the control unit 28 determines whether or not the conveyance direction length of the sheet detected based on the sheet detection information provided by the registration sensor 8 matches the conveyance direction length of the image to be recorded on the sheet. Further, if it is determined that the conveyance direction length of the sheet does not match the conveyance direction length of the image, the control unit 28 controls the sheet conveyance in accordance with the conveyance direction length of the sheet detected based on the sheet detection information provided by the registration sensor 8, to thereby convey and discharge the sheet.

With this configuration of conveying and discharging the sheet by controlling the sheet conveyance in accordance with the conveyance direction length of the sheet detected based on the sheet detection information provided by the registration sensor 8, the feeding of the second sheet is reliably prevented.

Further, in the image forming apparatus 50 according to Embodiment 1, if the registration sensor 8 does not detect the trailing end of the sheet by the sheet trailing end detection time of the registration sensor 8 calculated from the preset maximum conveyance direction length of the sheet, the control unit 28 determines a sheet conveyance failure, and stops the sheet conveyance.

With this configuration, it is possible to stop the sheet conveyance when there is a possibility of a sheet jam.

Embodiment 2

Figure 10:
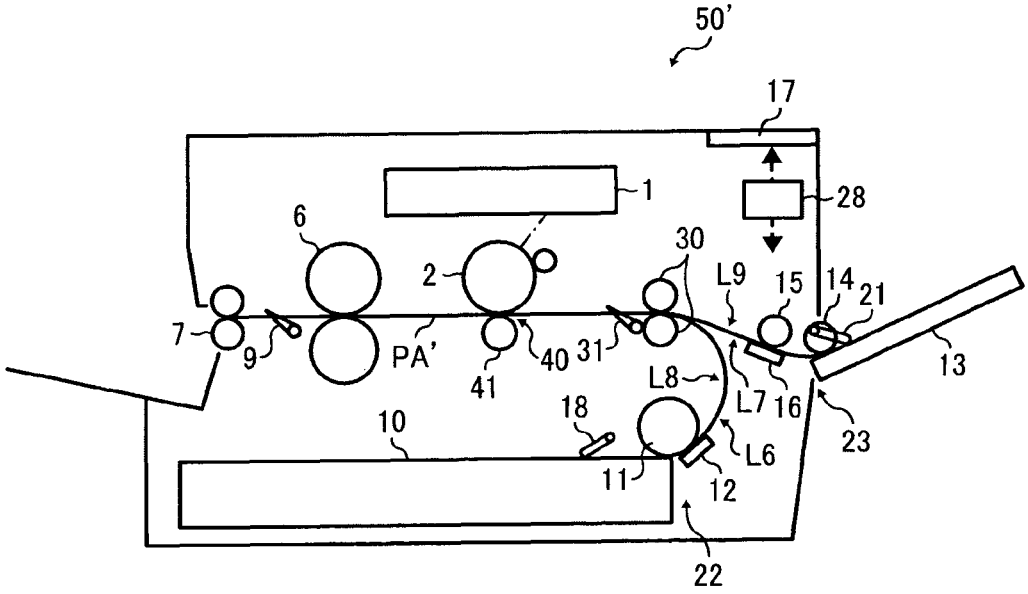
FIG. 10 is a diagram illustrating a schematic configuration of an image forming apparatus according to Embodiment 2 of the present invention.

Subsequently, Embodiment 2 of the present invention will be described. With reference to FIG. 10, a description will be given of a schematic configuration of an image forming apparatus according to Embodiment 2. The configuration of Embodiment 2 is formed not to waste the second sheet, even if the actually set sheet size is different from the user-set sheet size and the conveyance direction length of the actually set sheet is shorter than the conveyance direction length of the user-set sheet size. The components similar in configuration to the components of Embodiment 1 will be designated by the same reference numerals, and a description thereof will be omitted.

An image forming apparatus 50' according to Embodiment 2 is configured as a printer using a direct transfer method as the method of transferring an image to a sheet.

In the image forming apparatus 50', a sheet is fed from the sheet feeding unit 22 provided inside the image forming apparatus 50' and including the sheet feeding tray 10, the sheet feeding roller 11, and the separating device 12, or is fed from the manual sheet feeding unit 23 including the manual sheet feeding tray 13, the pickup roller 14, the sheet feeding roller 15, and the separating device 16. The image forming apparatus 50' conveys the thus fed sheet to a transfer unit 40, which includes a photoconductor 2 and a transfer roller 41, by using a pair of conveyance rollers 30. Further, in the image forming apparatus 50', a sheet detection sensor 31 for detecting a sheet is provided between the pair of conveyance rollers 30 and the transfer unit 40. The sheet travels along a conveying pathway PA' that extends from the sheet feeding roller 11 of the sheet feeding tray 10 or the sheet feeding roller 14 of the sheet feeding tray 13, via the pair of conveyance rollers 30, the transfer roller 41, and the fixing device 6 to the sheet discharging rollers 7.

In the image forming apparatus 50' that employs the direct transfer method, a partial length of the conveying pathway PA' from the sheet detection sensor 31 to the transfer unit 40 is longer than the image forming pathway length from the exposure position on the photoconductor 2 to the transfer unit 40. Therefore, the image forming apparatus 50' starts the image formation by performing the exposure process on the photoconductor 2 in proper timing with the sheet conveyance based on the information of the detection of the leading end of the sheet by the sheet detection sensor 31.

It is now assumed that "L6" represents a partial length of the conveying path PA' or a partial conveying pathway length in which a sheet is fed from the sheet feeding tray 10 by the sheet feeding roller 11 and reaches the transfer unit 40 via the pair of conveyance rollers 30, and that "L7" represents a partial length of the conveying path PA' or a partial conveying pathway length in which a sheet is fed from the manual sheet feeding tray 13 by the pickup roller 14 and the sheet feeding roller 15 and reaches the transfer unit 40 via the pair or conveyance rollers 30. In this case, each of the partial conveying pathway lengths L6 and L7 is shorter than the sheet length. That is, the partial conveying pathway length L6 is shorter than at least the conveyance direction length of the maximum size sheet placeable in the sheet feeding tray 10 of the sheet feeding unit 22, and the partial conveying pathway length L7 is shorter than at least the conveyance direction length of the maximum size sheet placeable in the manual sheet feeding tray 13 of the manual sheet feeding unit 23.

Further, it is now assumed that "L8" represents a partial length of the conveying pathway PA' or a partial conveying pathway length from the sheet feeding roller 11 of the sheet feeding unit 22 to the sheet detection sensor 31 via the pair of conveyance rollers 30, and that "L9" represents a partial length of the conveying pathway PA' or a partial conveying pathway length from the sheet feeding roller 15 of the manual sheet feeding unit 23 to the sheet detection sensor 31 via the pair of conveyance rollers 30. In this case, each of the partial conveying pathway lengths L8 and L9 is shorter than the conveyance direction length of the minimum size sheet placeable in the corresponding one of the sheet feeding tray 10 and the manual sheet feeding tray 13.

Figure 11:
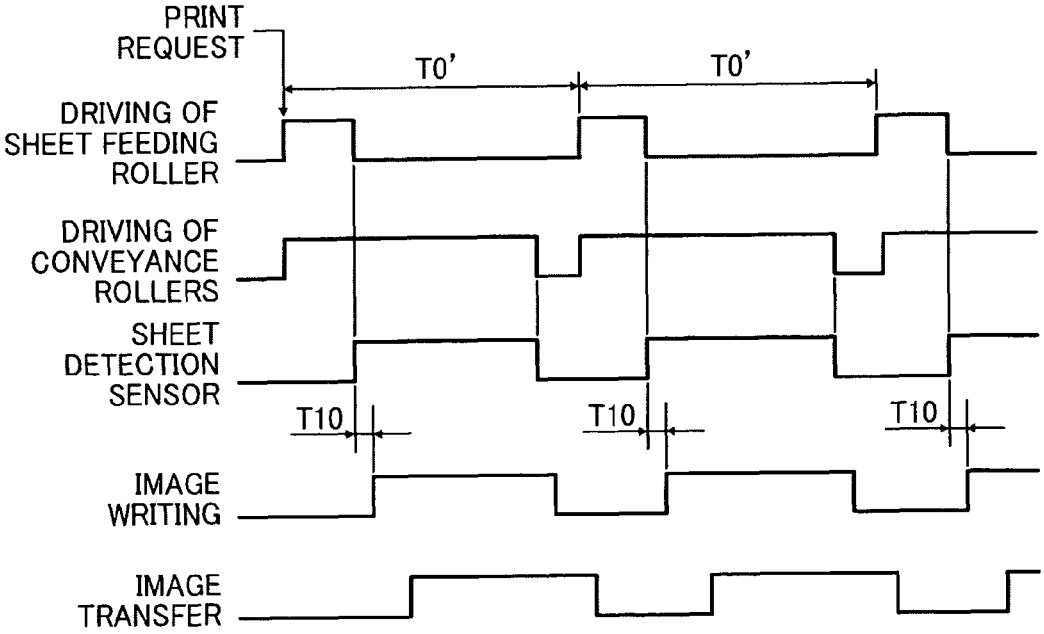
FIG. 11 is a timing chart illustrating sheet feeding and conveying timing of the image forming apparatus according to Embodiment 2 of the present invention.

With reference to the timing chart of FIG. 11, sheet feeding and conveying timing of Embodiment 2 will be described. Specifically, a description will be given of the supply of a sheet from the sheet feeding tray 10 of the sheet feeding unit 22 or the manual sheet feeding tray 13 of the manual sheet feeding unit 23.

When a print request is output and the image forming apparatus 50' is brought into the printable state, the selected one of the sheet feeding roller 11 of the sheet feeding unit 22 and the sheet feeding roller 15 of the manual sheet feeding unit 23 is driven to start feeding a sheet from the corresponding one of the sheet feeding unit 22 and the manual sheet feeding unit 23. The pair of conveyance rollers 30 is driven simultaneously with the start of driving of the sheet feeding roller 11 or the sheet feeding roller 15.

The fed sheet passes the pair of conveyance rollers 30, and the leading end of the sheet is detected by the sheet detection sensor 31. Then, after a predetermined time T10, the exposure process starts such that the sheet and the image match in timing in the transfer unit 40, thereby performing the image formation. Upon detection of the leading end of the sheet by the sheet detection sensor 31, the driving of the sheet feeding roller 11 or the sheet feeding roller 15 is stopped.

Similarly as in the configuration of Embodiment 1, the configuration of Embodiment 2 is formed such that, after the stop of driving of the sheet feeding roller 11 or the sheet feeding roller 15, the sheet is conveyed by the pair of conveyance rollers 30 and the sheet feeding roller 11 or the sheet feeding roller 15 is rotated in accordance with the movement of the sheet, and that, after the trailing end of the sheet passes the sheet feeding roller 11 or the sheet feeding roller 15, the rotation of the sheet feeding roller 11 or the sheet feeding roller 15 is stopped to prevent the feeding of the second sheet. Upon detection of the trailing end of the sheet by the sheet detection sensor 31, the driving of the pair of conveyance rollers 30 is stopped.

The partial conveying pathway length from the sheet feeding roller 11 or the sheet feeding roller 15 to the sheet detection sensor 31 via the pair of conveyance rollers 30 is shorter than the conveyance direction length of the minimum size sheet. In any combination of the user-set sheet size and the actually set sheet size, therefore, the driving of the sheet feeding roller 11 or the sheet feeding roller 15 is stopped before the trailing end of the actually set sheet passes the sheet feeding roller 11 or the sheet feeding roller 15. Accordingly, the feeding of the second sheet is reliably prevented.

In Embodiment 2, the conveyance direction length of the actually set sheet is detected based on the time elapsed from the detection of the leading end of the sheet to the detection of the trailing end of the sheet by the sheet detection sensor 31 and the sheet conveying speed of the pair of conveyance rollers 30.

Further, similarly as in Embodiment 1, the configuration of Embodiment 2 is formed such that, if it is determined, based on the result of detection of the conveyance direction length of the sheet, that the print size of the image to be printed by the user is different from the size of the sheet actually set in the sheet feeding tray 10 or the manual sheet feeding tray 13, a size mismatch warning is issued which notifies the user of the difference in sheet size.

In the case of continuous printing on a plurality of sheets, in the printable state of the image forming apparatus 50', the driving for feeding the second sheet starts after a predetermined time T0' since the start of driving for feeding the first sheet. Thereafter, the driving for sheet feeding is performed at regular intervals of the time T0'. Herein, the value of the time T0' is previously set in accordance with the sheet size in consideration of the time required for a variety of processes performed at sheet intervals.

The configuration of Embodiment 2 may be formed to provide a sheet detection device between the pair of conveyance rollers 30 and the sheet feeding rollers 11 and 15 such that the pair of conveyance rollers 30 functions similarly to the pair of registration rollers 4 of Embodiment 1 (see FIG. 1), and that a control is performed to correct the oblique conveyance of the sheet by temporarily stopping the sheet at the pair of conveyance rollers 30.

As described above, in the image forming apparatus 50' according to Embodiment 2, the sheet detection sensor 31 that detects a sheet is provided between the pair of conveyance rollers 30 and the transfer unit 40. Further, based on the sheet detection information provided by the sheet detection sensor 31, the control unit 28 switches the sheet feeding roller 11 or the sheet feeding roller 15 from the driven state to the non-driven state.

With this configuration, the driving of the sheet feeding roller 11 or the sheet feeding roller 15 is controlled based on the sheet detection information provided by the sheet detection sensor 31.

Further, in the image forming apparatus 50' according to Embodiment 2, the partial conveying pathway length L8 or the partial conveying pathway length L9 from the sheet feeding roller 11 or the sheet feeding roller 15, respectively, to the sheet detection sensor 31 is shorter than the conveyance direction length of the minimum usable size sheet.

With this configuration in which the conveying pathway length (L8 or L9) of the sheet from the sheet feeding roller 11 or the sheet feeding roller 15 to the sheet detection sensor 31 is shorter than the conveyance direction length of the minimum usable size sheet, it is possible to provide a small-sized and low-cost image forming apparatus that prevents the waste of the second sheet, a shift in position of the image, and an image failure such as shock jitter, even if the actually set sheet size is different from the user-set sheet size and the conveyance direction length of the actually set sheet is shorter than the conveyance direction length of the user-set sheet size.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The invention claimed is:

1. An image forming apparatus, comprising:

a recording unit to record an image on a recording medium at a transfer portion;

a registration device to convey the recording medium to the transfer portion, the registration device is located at shortest distance upstream side from the transfer portion;

a feeding device to supply the recording medium to the registration device;

a recording medium conveying pathway along which the recording medium travels and having a first partial length thereof extending from the feeding device to the transfer portion shorter than a conveyance direction length of a maximum usable size recording medium;

a recording medium detection device provided between the registration device and the feeding device, and to detect the recording medium; and a control device to control the driving of the registration device and the feeding device, wherein the control device starts driving the registration device to convey the recording medium to the transfer portion after detection of the recording medium by the recording medium detection device, and stops the feeding device before a leading end of the recording medium reaches the transfer portion and after the registration device is driven.

2. The image forming apparatus according to claim 1, further comprising:

a recording medium storage unit to store a plurality of stacked recording media, wherein the feeding device separates and feeds a single recording medium from the recording medium storage unit.

3. The image forming apparatus according to claim 2, wherein a second partial length of the recording medium conveying pathway extending between the feeding device and the registration device lacks a device for conveying the recording medium.

4. The image forming apparatus according to claim 1, wherein, when the feeding device is switched from a driven state to a non-driven state after the start of driving of the registration device to convey the recording medium supplied by the feeding device to the transfer portion, a third partial length of the recording medium conveying pathway extending between the position of the leading end of the recording medium and the feeding device is shorter than a conveyance direction length of a minimum usable size recording medium.

5. The image forming apparatus according to claim 4, wherein the control device detects the conveyance direction length of the recording medium based on the recording medium detection information provided by the recording medium detection device.

6. The image forming apparatus according to claim 5, wherein, if it is determined that the conveyance direction length of the recording medium detected based on the recording medium detection information provided by the recording medium detection device is longer than the conveyance direction length of the image to be recorded on the recording medium, the control device performs the process of handling a size mismatch of the recording medium and issues a warning of the size mismatch.

7. The image forming apparatus according to claim 4, wherein the control device determines whether or not a conveyance direction length of the recording medium detected based on the recording medium detection information provided by the recording medium detection device matches a conveyance direction length of the image to be recorded on the recording medium, and wherein, if it is determined that the conveyance direction length of the recording medium does not match the conveyance direction length of the image, the control device performs a process of handling the size mismatch of the recording medium and issues a warning of the size mismatch.

8. The image forming apparatus according to claim 4, wherein the control device determines whether or not a conveyance direction length of the recording medium detected based on the recording medium detection information provided by the recording medium detection device matches a conveyance direction length of the image to be recorded on the recording medium, and wherein, if it is determined that the conveyance direction length of the recording medium does not match the conveyance direction length of the image, the control device performs the conveyance and discharge of the recording medium by controlling the conveyance of the recording medium in accordance with the conveyance direction length of the recording medium detected based on the recording medium detection information provided by the recording medium detection device.

9. The image forming apparatus according to claim 4, wherein, if the recording medium detection device does not detect a trailing end of the recording medium by a recording medium trailing end detection time of the recording medium detection device calculated from a preset maximum conveyance direction length of the recording medium, the control device determines a recording medium conveyance failure, and stops the conveyance of the recording medium.

10. The image forming apparatus according to claim 1, wherein the control device switches the feeding device from a driven state to a non-driven state based on recording medium detection information provided by the recording medium detection device.

11. The image forming apparatus according to claim 10, wherein a fourth partial length of the recording medium conveying pathway extending from the feeding device to the recording medium detection device is shorter than a conveyance direction length of a minimum usable size recording medium.

12. The image forming apparatus according to claim 1, wherein, based on recording medium detection information provided by the recording medium detection device, the control device stops the driving of the feeding device to cause the recording medium to stop in front of the registration device or be abutted against and stopped by the registration device, and wherein the control device switches the feeding device from a driven state to a non-driven state after the lapse of a set time since the start of driving of one of the feeding device and the registration device to convey the recording medium to the transfer portion.

13. A method for controlling an image forming apparatus having a recording medium feeding device and a recording medium registration device, the method comprising:

recording an image on a recording medium at a transfer portion;

conveying the recording medium via the registration device to the transfer portion, the registration device is located at shortest distance upstream side from the transfer portion;

supplying the recording medium to the registration device;

detecting the recording medium with a detection device provided between the feeding device and the registration device;

driving the registration device to convey the recording medium to the transfer portion after detection of the recording medium by the detection device; and stopping the feeding device before a leading end of the recording medium reaches the transfer portion and after the registration device is driven.

* * * * *